United States Patent [19]

Fukura et al.

[11] 4,306,378

[45] Dec. 22, 1981

[54] WINDOW REGULATOR FOR AUTOMOTIVE VEHICLES

[75] Inventors: Kenichi Fukura, Toyota; Masatoshi Hirooka, Kariya, both of Japan

[73] Assignee: Aisin Seiki Kabushiki Kaisha, Kariya, Japan

[21] Appl. No.: 117,034

[22] Filed: Jan. 31, 1980

[30] Foreign Application Priority Data

Feb. 9, 1979 [JP] Japan ..... 54-16536[U]

[51] Int. Cl.[3] ..... E05F 11/48

[52] U.S. Cl. ..... 49/352

[58] Field of Search ..... 49/352, 360, 349, 374; 474/111, 133, 140

[56] References Cited

U.S. PATENT DOCUMENTS

| | | | |
|---|---|---|---|
| 1,503,500 | 8/1924 | Heintz | 49/352 X |
| 1,640,931 | 8/1927 | Gettner | 49/352 |
| 2,555,859 | 6/1951 | Rappl et al. | 49/352 |
| 3,071,980 | 1/1963 | Brewer | 474/133 |
| 4,095,370 | 6/1978 | Muehling | 49/352 |
| 4,191,060 | 3/1980 | Sessa | 49/352 X |

*Primary Examiner*—Philip C. Kannan

*Attorney, Agent, or Firm*—Finnegan, Henderson, Farabow, Garrett & Dunner

[57] ABSTRACT

A window regulator for automotive vehicles which has a reciprocable wire operable to raise and lower a window along a guide rail within a door. The window regulator includes a wire driving mechanism for driving the wire according to the operation of a handle lever, and an auxiliary mechanism including a torsion spring integrated with the wire driving mechanism for assisting in raising the window and serving as a resistance to lowering the window.

5 Claims, 6 Drawing Figures

WINDOW REGULATOR FOR AUTOMOTIVE VEHICLES

BACKGROUND OF THE INVENTION

1. Field of the Invention

The present invention relates to a window regulator for automotive vehicles, and more particularly to a window regulator utilizing a reciprocable wire.

2. Description of the Prior Art

In many conventional window regulators, the wire driving mechanism for raising and lowering the window is of such a width that it becomes difficult to install the wire driving mechanism between the window and an inner door panel. Also, an auxiliary mechanism for smoothly raising the window and serving as a resistance during lowering of the window often is separately provided from the wire driving mechanism. As a result, a large number of separate parts are required.

SUMMARY OF THE INVENTION

An object of the present invention is to provide an improved window regulator for automotive vehicles which obviates the aforementioned drawbacks of the described conventional devices.

A further object of the present invention is to provide an improved window regulator which employs a reciprocable wire and includes an auxiliary mechanism integrated with a wire driving mechanism and which assists in raising the window and resists its lowering.

Still further important objects of this invention are to provide an improved window regulator of the aforementioned type which is narrow and compact and readily fits between the window and inner door panel, and which is relatively simple and includes a minimum of parts.

Another object of this invention is to provide an improved window regulator of the aforementioned type which includes a wire adjusting mechanism to take up slack in the wire and insure proper tension therein.

Additional objects and advantages of this invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention as embodied and broadly described herein, this invention is directed to a window regulator for automotive vehicles which includes reciprocable wire means for raising and lowering a window along a guide rail within a door, and comprises: a wire driving mechanism including a casing fixed to a vehicle door, a core member having a handle lever fixed thereto and provided with an axial portion, a shaft fixed to an outer periphery of the core member axial portion, and a pully fixed to an outer periphery of the shaft and provided with a groove thereon; an auxiliary mechanism including a torsion spring having one end engaged with the shaft and the other end engaged with the casing, the torsion spring being wound when the shaft is turned in a direction to lower the window, and unwound when the shaft is turned in a direction to raise the window, whereby the torsion spring assists in raising and resists lowering the window.

BRIEF DESCRIPTION OF THE DRAWINGS

Various other features, objects and attendant advantages of the present invention will become self-evident when considered in connection with the accompanying drawings wherein.

DETAILED DESCRIPTION OF THE PREFERRED EMBODIMENT

Figure 1:
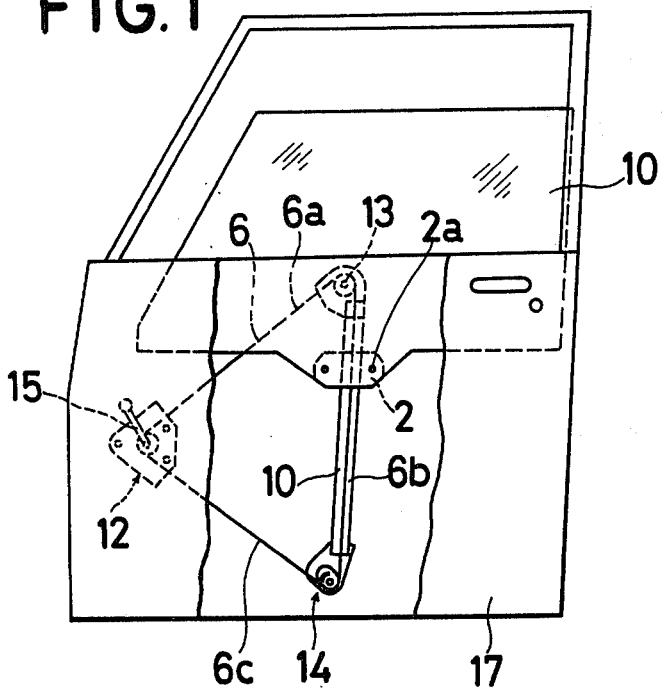
FIG. 1 is a partially sectioned view of an automotive vehicle door which shows a preferred embodiment of a window regulator according to the invention.
Figure 2:
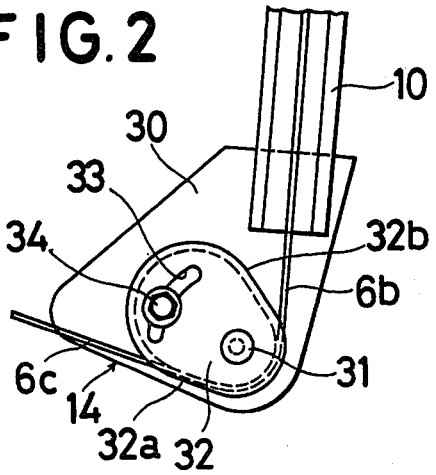
FIG. 2 is an enlarged view of a portion of FIG. 1 showing a wire adjusting mechanism.

Referring now to FIG. 1 an automotive vehicle door 1 is shown as having a window 11 mounted for movement thereon. The window 11 is fixed to a bracket 2 by pins 2*a*. A slide shoe 3 is fixed to or formed integral with the bracket 2 (FIG. 3) and is slidably guided in a guide shoe 10 fixed inside the door 1. The bracket 2 and the slide shoe 3 can be formed of plastic material and can be integrally molded.

Figure 3:
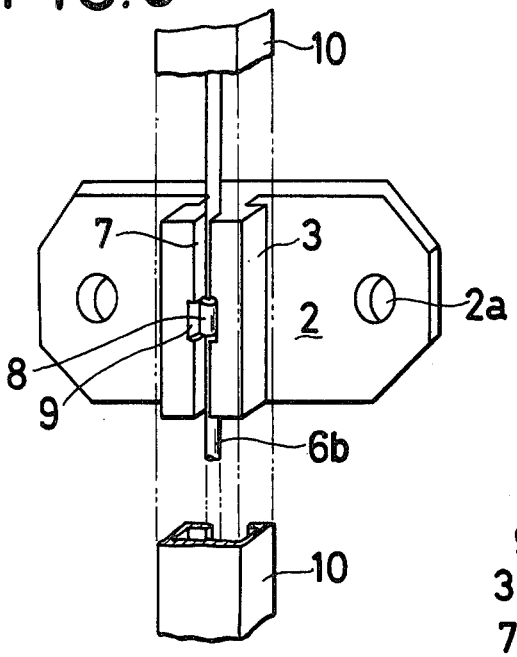
FIG. 3 is an enlarged view of a portioned FIG. 1 showing a guide rail structure.
Figure 4:
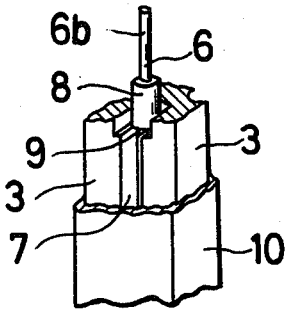
FIG. 4 is a partially sectioned view of a portion of FIG. 3.

In accordance with the invention, a reciprocable wire means is provided to raise and lower the window 11. As embodied herein, the slide shoe 3 is provided with a longitudinal groove 7 (FIG. 3). A wire 6 extends through the groove 7 and is fixed to the shoe 3 by a cylindrical member 8 which is clamped to the wire 6 and trapped in a recess 9 in the slide shoe 3 (see also FIG. 4). Thus, when the wire 6 is driven (reciprocated), it raises and lowers the window 11.

Figure 5:
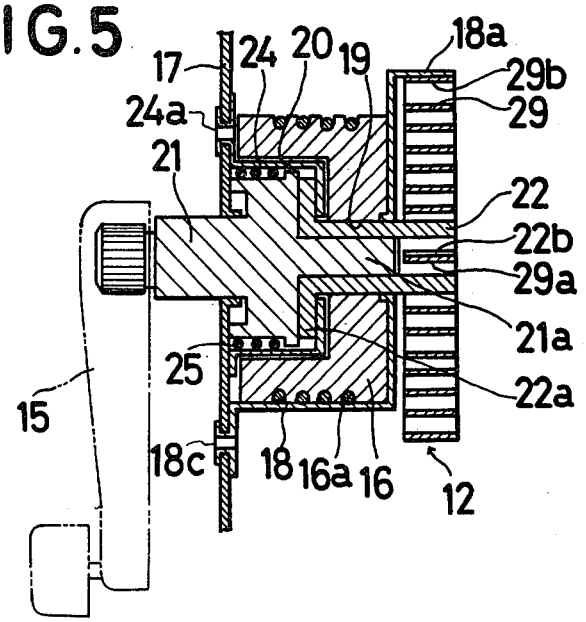
FIG. 5 is an enlarged sectional view showing the wire driving mechanism of FIG. 1.
Figure 6:
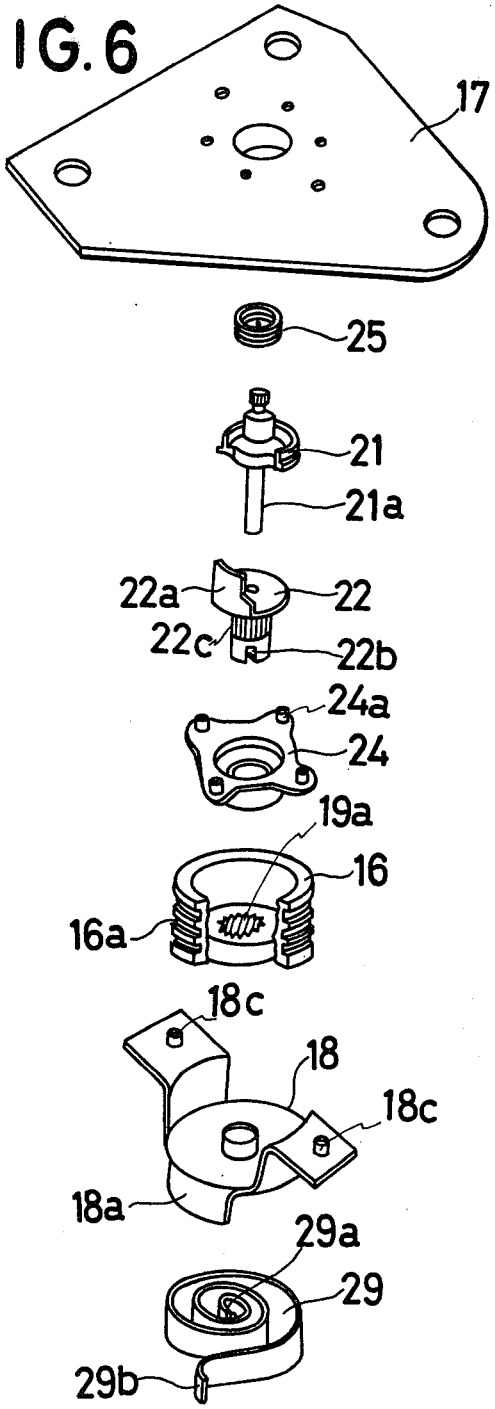
FIG. 6 is an exploded perspective view of the wire driving mechanism of FIG. 5.

In accordance with the invention, a wire driving mechanism is provided to reciprocate the wire 6. As embodied herein, the wire driving mechanism is generally indicated at 12 in FIGS. 1 and 5 and is seen to include a base plate 17 fixed to an inner panel of door 1. A pulley 16 is rotatably supported upon the base plate 17 by a case 18 having a sleeve 18*b* which fits into an opening 19 in the pulley 16. The case 18 is fastened to the base plate 17 by fasteners 18*c*.

The pulley opening 19 has a splined portion 19*a* which receives a splined portion 22*c* of a shaft 22. A core 21 extends through and is rotatably supported upon the base plate 17 and has an axial portion 21*a* which extends into and is fixed to shaft 22. A handle 15 is fixed to core 21 so that by turning the handle 15, the pulley 16 is turned.

The pulley 16 is formed with a spiral groove 16*a* on its outer surface. The wire 6 is entrained over a guide roller 13 and a wire adjusting mechanism 14 which divide the wire 6 into three segments 6*a*, 6*b*, 6*c*. Segment 6*b* is fixed to slide shoe 3, and the terminal ends of segments 6*a* and 6*c* are fixed in the groove 16*a* of pulley 16. Thus, when the pulley 16 is turned in a counterclockwise direction, as seen in FIG. 1, wire segment 6*a* is wound on pulley 16 while segment 6*c* is unwound and window 11 is raised. Conversely, when pulley 16 is turned clockwise, segment 6*c* is wound on the pulley while segment 6*a* is unwound and window 11 is lowered.

In accordance with the invention, the wire adjusting mechanism 14 is constructed to take up slack in the wire and to provide proper tension in the wire 6. As embodied herein, the adjusting mechanism 14 includes a regulating member 32 pivotally mounted by a pin 31 on a bracket 30 fixed to the door 1. The regulating member has cam faces 32*a*, 32*b* against which the wire 6 can bear. An arcurate slot 33 is formed in the member 32 and receives a bolt 34 which is fixed to the bracket 30. The member 32 is adjusted by pivoting about pin 31 to take up the slack in wire 6 and properly tension it, and then is fixed in this adjusted position by tightening the bolt 34.

In accordance with the invention, an auxiliary mechanism integrated with the wire driving mechanism 12 assists in raising the window 11 and resists its lowering. As embodied herein, the auxiliary mechanism includes a torsion spring 29 having an inner end 29*a* inserted in a slot 22*b* formed in the end of shaft 22, and an outer end 29*b* which engages a flange 18*a* formed on case 18. The spring 29 is wound in a direction so that when the handle 15 and pulley 16 are turned in a clockwise direction as seen in FIG. 1 to lower the window 11, the spring 29 is wound to a tightened or compressed condition. The spring 29 therefore serves as a resistance to the dead weight of the window 11 and to rotation of the pulley 16 and prevents the window 11 from sudden lowering.

When the handle 15 and pulley 16 are turned in a counter-clockwise direction to raise the window 11, the torsion spring 29 unwinds or stretches and assists the rotational torque of the handle 15 through the shaft 22 and core 21. This, in turn, assists the wire segment 6*a* in winding on pully 16 and in raising the window 11.

Means is provided to prevent the window 11 from being lowered by manually pushing downwardly on it. As embodied herein, a coil spring 25 is disposed in a gap between the outer periphery of core 21 and the inner periphery of a casing 24 fixed to base plate 17 by fasteners 24*a*. The spring 25 has one end engaged with a projecting portion 22*a* of shaft 22 and its other end frictionally engaged with casing 24. The spring 25 acts as a one-way clutch allowing the core 21 and shaft 22 to be turned by the handle 15 but prevents the core 21 and shaft 22 from being turned when downward force is applied to window 11.

By the foregoing, there has been disclosed a preferred form of automotive window regulator constructed in accordance with the present invention. It will be appreciated that various additions, substitutions, modifications and omissions may be made thereto without departing from the spirit of the invention.

What is claimed is:

1. A window regulator for automotive vehicles which includes reciprocable wire means for raising and lowering a window along a guide rail within a door, comprising:

a wire driving mechanism including a base plate fixed to a vehicle door, a casing fixed to said base plate, a core member having a handle lever fixed thereto and provided with an axial portion, a cylindrical shaft fixed to an outer periphery of said core member axial portion, and having a portion extending axially beyond said core member, and a pulley fixed to an outer periphery of said shaft and provided with a spiral groove thereon, said core member, shaft, and pulley being rotatably supported by said base plate and said casing;

an auxiliary mechanism including a torsion spring having one end engaged with the portion of said shaft extending axially beyond said core member and the other end engaged with said casing, said torsion spring being wound when said shaft is turned in a direction to lower said window, and unwound when said shaft is turned in a direction to raise said window, whereby said torsion spring assists in raising and resists lowering said window.

2. A window regulator of the type set forth in claim 1, said shaft being provided with a slot which receives one end of said torsion spring.

3. A window regulator of the type set forth in claim 1, said casing being provided with a flange engaged with the other end of said torsion spring.

4. A window regulator of the type set forth in claim 1, said wire driving mechanism further including a coil spring between said outer periphery of said core and an inner periphery of said casing, said coil spring acting as a one-way clutch preventing said shaft from turning by downward force on said window.

5. A window regulator of the type set forth in claim 1, further comprising:

a wire adjusting mechanism including a bracket fixed to an inner panel of said door, a regulating member having cam faces engaging said wire and pivotally mounted on said bracket through a pin and provided with an arcurate slot, and a bolt extending through said slot and adapted to fix said regulating member to said bracket after adjustment.

* * * * *